US005714872A

United States Patent [19]

Heimerl et al.

[11] Patent Number: 5,714,872

[45] Date of Patent: Feb. 3, 1998

[54] TELECOMMUNICATION TERMINAL WITH VOLTAGE CONTROLLER HAVING A PHASE-SHIFTING COMPONENT AND A FEEDBACK PATH

[75] Inventors: Emil Heimerl, Schwabach; Josef Einzinger, Georgensgmünd; Jürgen Hauenschild, Nürnberg, all of Germany

[73] Assignee: U.S. Philips Corporation, New York, N.Y.

[21] Appl. No.: 670,261

[22] Filed: Jun. 14, 1996

[30] Foreign Application Priority Data

Jun. 14, 1995 [DE] Germany ..... 195 21 663.6

[51] Int. Cl.[6] ..... G05F 1/56

[52] U.S. Cl. ..... 323/273; 323/280

[58] Field of Search ..... 323/273, 274, 323/275, 276, 277, 280, 282, 284, 286; 363/89

[56] References Cited

U.S. PATENT DOCUMENTS 4,968,928 11/1990 Heider ..... 323/275
5,264,782 11/1993 Newton ..... 323/288
5,517,399 5/1996 Yamauchi et al. ..... 363/89

FOREIGN PATENT DOCUMENTS

0531945A2 3/1993 European Pat. Off. ..... G05F 1/56

*Primary Examiner*—Adolf Berhane
*Attorney, Agent, or Firm*—Steven R. Biren

[57] ABSTRACT

A telecommunication terminal has a voltage controller (8) which controller forms at least part of an integrated circuit (1) and includes a differential amplifier (14) having a first input (+) for receiving a reference voltage (UREF), means (16, 20) for applying a load current (22) that is provided with at least one phase shifting component (23) as a function of an output voltage of the differential amplifier (14), and a feedback path for feeding back a voltage drop at the load (22) to the second (−) of the two inputs of the differential amplifier. To provide a maximum suppression of disturbances of the output voltage over a wide frequency range and guarantee the stability of the voltage controller, the phase shifting component (23) is arranged outside the integrated circuit (1) and a plurality of separate pins (4, 5) of the integrated circuit (1) are provided for coupling the phase shifting component (23) to the output of the means (16, 20) for producing a load current and to the feedback path. The invention likewise relates to a respective integrated circuit.

16 Claims, 1 Drawing Sheet

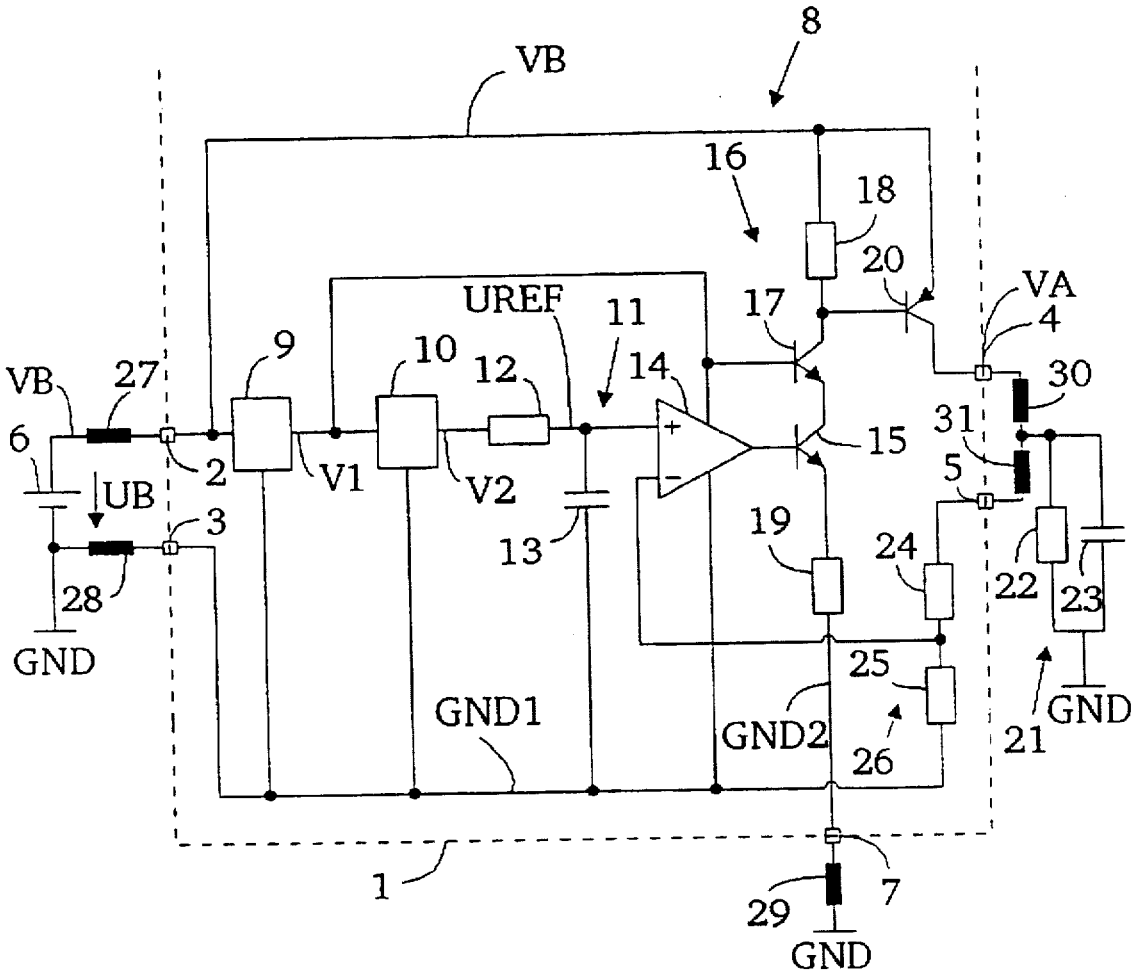
8
VB
16
18
20
VA
4
UREF
11
17
9
10
12
14
30
VB
27
6
2
V1
V2
15
31
5
UB
3
13
19
24
22
23
28
GND
25
GND1
GND2
26
21
GND
1
29
7
GND

TELECOMMUNICATION TERMINAL WITH VOLTAGE CONTROLLER HAVING A PHASE-SHIFTING COMPONENT AND A FEEDBACK PATH

TECHNICAL FIELD

The invention relates to a telecommunication terminal with a voltage controller which controller forms at least part of an integrated circuit and comprises a differential amplifier having a first input for receiving a reference voltage, means for applying a load current to a load that is provided with at least one phase shifting component as a function of an output voltage of the differential amplifier, and a feedback path for feeding back a voltage drop at the load to the second of the two inputs of the differential amplifier.

Such a telecommunication terminal is often a mobile radio set. The invention may, however, also be used for other telecommunication terminals, for example, for corded and cordless telephones.

BACKGROUND OF THE INVENTION

From EP 0 531 945 A2 is known a low-value voltage controller comprising a differential amplifier arranged as an operational amplifier whose non-inverting input is supplied with a reference voltage. The output of the operational amplifier controls a power transistor which is coupled to the output of the voltage controller and supplies a current to a connected load through the output. The power transistor is linked to a voltage source connected to the input of the voltage controller. A capacitor is connected in parallel between the power transistor and the output of the voltage controller.

The output voltage of the operational amplifier is fed back in this circuit to the inverting input of the operational amplifier by means of a feedback path which comprises a series combination of a capacitor and a resistor. In addition, the voltage available on the output of the voltage controller is applied to the inverting input of the operational amplifier via a resistor.

The internal frequency compensation by the operational amplifier feedback path which comprises a capacitor and a resistor causes a deterioration of the differential gain already in small frequency ranges. In the case of high-frequency changes of the output load or of the supply voltage this leads to a longer transient period of the voltage controller. This problem especially occurs when such a voltage controller is used in an integrated circuit.

SUMMARY OF THE INVENTION

It is an object of the invention to provide a telecommunication terminal with a voltage controller, in which terminal the disturbances of the supply voltage applied to the voltage controller have, over a large frequency range, only a negligibly small influence on the controlled voltage controller output voltage applied to the load. In addition, the stability of the voltage controller during such disturbances is to be guaranteed.

The object is achieved in that the phase shifting component is arranged outside the integrated circuit and in that a plurality of separate pins of the integrated circuit are provided for coupling the phase shifting component to the output of the load current supply means and to the feedback path.

The phase shifting component is used for stabilizing the voltage controller. The phase shifting component is particularly a capacitor arrangement, but it is likewise possible to realize same via an arrangement of one or more inductance components. The phase shifting component provides the pole necessary for stabilizing the controller. When realized by means of a capacitor arrangement, this pole can also be produced for small capacitances of the capacitor arrangement due to the wide band of the differential amplifier. Since the phase shifting component together with the load is connected to the integrated circuit from the outside, one has more variations in the realization when compared with the realization on the integrated circuit chip.

However, with the phase shifting component connected from the outside, the problem occurs that for high frequencies and when only a single pin is used, this component is decoupled from the control loop of the voltage controller as a result of parasitic inductances, and thus loses its effect. The parasitic inductances particularly originate from line inductances of the connecting wires by which the pins of the integrated circuit are connected to its chip by bonds, from line inductances of the lines from the pins to the phase shifting component or to the load respectively, and from the inductance of the housing of the integrated circuit. By using two separate pins which are both connected to the circuit section comprising the phase shifting component and the load, a decoupling of the phase shifting component from the control loop is avoided for high-frequencies, which decoupling is determined by parasitic inductances. Either pin is used as a sensor input through which the voltage available on the circuit section that comprises the phase shifting component and the load affects the control circuit also for high frequencies, so that the phase shifting component does not lose its effect for high frequencies either.

In an embodiment of the invention, the load current supply means comprise a transistor arrangement and a cascode combination for coupling the output of the differential amplifier to the control input of the transistor arrangement supplying the load current. The cascode combination is used for transforming the impedance. It allows the load present on the output of the control circuit and thus on the output of the transistor arrangement to appear as a low-impedance load.

Another embodiment of the invention has two separate ground leads which are coupled to an external ground lead via two pins of the integrated circuit in the integrated circuit for the differential amplifier and the cascode combination. In the case of fluctuations or disturbances of the supply voltage supplied by an external voltage source (for example, a battery), when only a single ground lead is used in the integrated circuit and thus also only a single pin for connecting an external ground potential, there is the problem that the parasitic inductances assigned to this pin lead to fluctuations of the internal ground potential (occurring inside the integrated circuit). Compared with the differential amplifier a large current then flows through the cascode combination, which current leads to a shift of the internal ground potential in dependence on the magnitude of the current, which fact in its turn has an undesired effect on the differential amplifier. When the ground leads for the cascode combination and the differential amplifier in the integrated circuit are decoupled in the manner described, the ground potential for the differential amplifier is not affected by the current flowing through the cascode combination and thus continues to be substantially constant. There is avoided that the function of the differential amplifier is affected by fluctuations of the ground potential.

Provided that a voltage divider is used for coupling the load to the feedback path, the controlled voltage produced on the output of the voltage controller can be set in a simple manner. The associated voltage divider ratio can be simply set and adjusted in particular by a programmable voltage divider known per se.

A further embodiment is characterized in that a constant voltage source coupled to an external voltage source via a pin of the integrated circuit produces the reference voltage. In this manner, a potentially strongly fluctuating supply voltage of the external voltage source can be simply reduced to a reference voltage and be used as such. The reference voltage thus produced is subjected to considerably smaller fluctuations than the supply voltage, so that also the controlled voltage produced by the voltage controller on its output can be maintained constant. For generating the reference voltage, it is also possible to combine a plurality of constant voltage sources to a single constant voltage source.

Inserting a low-pass filter between the constant voltage source and the wideband differential amplifier creates a further advantageous embodiment of the invention. Constant voltage sources usually have a low-pass characteristic, so that in the present application high-frequency disturbances superimposed on the supply voltage (of the external voltage source) are attenuated. For the case where the low-pass limit frequency of the constant voltage source is not large enough and parts of the disturbances are not attenuated sufficiently, the additional low-pass filter also provides an attenuation of these types of disturbances.

The invention likewise relates to an integrated circuit comprising a voltage controller which includes a differential amplifier having a first input for receiving a reference voltage, means for applying load current to a load in dependence on an output voltage of the differential amplifier, while the load being arranged inside or outside the integrated circuit and the load being connected to at least one phase shifting component, and a feedback path for feeding back to the second of the two inputs of the differential amplifier a voltage drop at the load, a plurality of separate pins of the integrated circuit being provided for coupling the phase shifting component to be arranged outside the integrated circuit to the output of the means for producing a load current and to the feedback path.

BRIEF DESCRIPTION OF THE DRAWINGS

The drawing shows an integrated circuit comprising a voltage controller.

DETAILED DESCRIPTION

The integrated circuit 1 denoted by a dashed line is represented in the drawing Figure in so far as this is necessary for the representation of the invention. For clarity, the further parts of the integrated circuit are omitted. The integrated circuit 1 has pins 2, 3, 4 and 5. The pins 2 and 3 are connected to an external voltage source 6, so that a potential VB is available on the pin 2 and a ground potential GND on pin 3. The ground potential GND is supplied to the integrated circuit 1 from the exterior via a further pin 7. The voltage source 6 is, in essence, a battery that produces a supply voltage UB which fluctuates between, for example, 3 and 7 volts.

The supply voltage UB is applied to a voltage controller 8 via the pins 2, 3 and 7. This controller is realized on the semiconductor chip (not shown any further) of the integrated circuit 1. At the input of the voltage controller 8 is arranged a first constant voltage source 9 to which are applied the supply voltage UB, the potential VB and the ground potential GND respectively, via the pins 2 and 3. The ground lead in the integrated circuit, which lead is coupled to the external ground potential GND via pin 3 is referenced GND1. The first constant voltage source 9 produces from the supply voltage UB a potential V1 which has, for example, the value of 2.6 volts. This potential V1 is applied to a second constant voltage source 10, which is also connected to the ground lead GND1. The second constant voltage source 10 forms a potential V2 therefrom which has, for example, the value of 1.2 volts. The potential V2 is applied to a low-pass filter 11 which comprises a resistor element 12 and a capacitive element 13 and whose output is connected to the non-inverting input of a wideband differential amplifier 14 to apply a reference voltage UREF to this input. The voltage supply of the differential amplifier 14 is effected by the potential V1 and the ground potential GND1.

The output of the differential amplifier 14 is coupled to the base terminal of the input transistor 15 of a cascode combination. The cascode combination 16 further includes an output transistor 17, the base terminal of which is supplied with the potential V1. The collector of the transistor 17 is coupled to the potential VB via a collector resistor 18. The emitter of the input transistor 15 is coupled to the ground potential GND2 via an emitter resistor 19. The cascode combination 16 is used for transforming the impedance, so that for the voltage controller the connected load 22 appears as a low impedance load. For increasing the power of the cascode combination, further resistors and transistors can be connected in parallel with the resistors 18 and 19 and the transistors 15 and 17, respectively.

The collector of the output transistor 17 of the cascode combination 16 is connected to the base terminal of a PNP power transistor 20 whose emitter is supplied with the potential VB.

The collector of the power transistor 20 is coupled via the pin 4 to a parallel combination 21 formed by a load 22 and a capacitor arrangement, in this case formed by only a single capacitor 23. The parallel combination 21 represents an external wiring of the integrated circuit 1 or of the voltage controller 8, respectively. The terminal of the parallel combination 21 connected to the pin 4 is also connected to the pin 5 which is coupled to the ground potential GND1 via the voltage divider 26 formed by two resistors 24 and 25. The voltage available on the central tap of the voltage divider 26 is applied to the inverting input of the wideband differential amplifier 14. Via the pin 5 and the voltage divider 26 it is thus possible to feed back a voltage drop at the parallel circuit 21 and thus a voltage drop at the load 22 to the inverting input of the differential amplifier 14. The voltage divider 26 makes a simple setting possible of the voltage value of the controlled output potential VA or of the controlled output voltage respectively, by setting a respective voltage divider ratio. Typical values for the controlled output voltage lie around about 3 volts.

The differential amplifier 14 has a bandwidth which is considerably larger than the bandwidth of the whole voltage control circuit. This is necessary, because the differential amplifier 14 is to suppress disturbances or fluctuations of the supply voltage UB or of the potential VB respectively, over a wide frequency range. Such disturbances are also already suppressed by the constant voltage sources 9 and 10 which have low-pass characteristics. In order to support the low-pass filtering by the constant voltage sources 9 and 10, a low-pass filter 11 may optionally be inserted between the constant voltage source 10 and the non-inverting input of the differential amplifier 14 to produce the reference voltage Uref, as is shown in the drawing Figure.

The controlled output potential VA of the voltage controller 8 is available on pin 4. The potential difference between the output potential VA and the external ground potential GND is the controlled output voltage of the voltage controller 8. The voltage controller may be used both for supplying a voltage to an external load 22 as in this illustrative embodiment, and for supplying a voltage to an internal load i.e. arranged inside the integrated circuit 1. The respective controlled load current is supplied by the power transistor 20.

The externally connected capacitor 23 is used for stabilizing the voltage controller 8. It produces the dominant pole necessary for stabilizing the circuit. The wider the band of the differential amplifier 14 is, the smaller the capacitances of the capacitor 23 can be, without the voltage controller becoming unstable. A typical value for the capacitance of the capacitor 23 is 100 nF. As against commercially available voltage controllers, the necessary capacitance of the capacitor 23 is lowered. The result is a simplified dimensioning of the external wiring of the integrated circuit 1.

Furthermore, parasitic inductances 27, 28, 29, 30 and 31 are shown in the drawing Figure. They are activated when high frequencies occur on the pins 2, 3, 4, 5 and 7 of the integrated circuit 1. In the event of high-frequency disturbances of the supply voltage UB or of the potential VB respectively, the internal ground potential GND2 coupled to the cascode combination 16 fluctuates because of the activity of a parasitic inductance 29 via which the internal ground potential GND2 is coupled to the external ground potential GND. In order to avoid a reaction to such fluctuations on the ground potential GND1 which is applied to the differential amplifier 14, internal ground potentials GND1 and GND2 in the integrated circuit 8 are separated. They are separately coupled to the external ground potential GND via the two pins 3 and 7. In this manner the ground potential GND1 applied to the differential amplifier 14 can also be maintained substantially constant even in the case of disturbances of the supply voltage UV or of the potential VB, respectively.

For high-frequency disturbances of the supply voltage UB, which are noticed in high-frequency parts of the controlled output potential VA on pin 4, both the parasitic inductance 30 connected to pin 4 and the parasitic inductance 31 connected to pin 5 are activated. Both inductances 30 and 31 then have high impedance values. This leads to respective high-frequency load currents produced by the power transistor 20 flowing to the ground potential GND in essence via the parallel combination 21. Only a very small part of the high-frequency components of the load current flows through the parasitic inductance and the pin 5. The voltage on pin 5 is thus, in essence, equal to the voltage drop at the parallel combination 21 because of the high impedance of the parasitic inductance 31 for high frequencies, so that the pin 5 here serves as a sensing element for the voltage drop at the parallel combination 21. The efficacy of the capacitor 23 necessary for the stability of the voltage controller 8 continues to be ensured. This capacitor is not decoupled from the feedback path of the voltage controller 8 and thus from the inverting input of the differential amplifier 14. When only a single pin is used for connecting the parallel combination 21 formed by the load 22 and the capacitor 23, the connected capacitor is decoupled from the feedback path because of the parasitic inductance of the pin, so that the voltage controller arranged in this way becomes unstable.

The described integrated circuit comprises a voltage controller which has a very good decoupling of the controlled output voltage from the supply voltage UB. Disturbances of the supply voltage UB can be compensated for over a wide range of voltage fluctuations and a wide range of frequencies. In lieu of providing the load 22 with the capacitor 23, the load 22 may, in principle, also be provided with an arrangement of various capacitors or an arrangement of one or various inductances or an arrangement of one or more capacitors and one or various inductances for the same purpose. The arrangement shown forms part of a telecommunication terminal, for example, a mobile radio set and is used for its voltage supply. The further parts of the telecommunication terminal are not shown, because they are not necessary for a full comprehension of the invention.

The foregoing merely illustrates the principles of the invention. It will thus be appreciated that those skilled in the art will be able to devise various arrangements which, although not explicitly described or shown herein, embody the principles of the invention and are thus within its spirit and scope.

We claim:

1. A telecommunication terminal, with a voltage controller (8) which forms at least part of an integrated circuit (1) and comprises:

a differential amplifier (14) having a first noninverting input (+) for receiving a reference voltage (UREF), means (16, 20) for applying a load current to a load (22) that is provided with at least one phase shifting component (23) in dependence on an output voltage of the differential amplifier (14), and a feedback path for feeding back a voltage at the load (22) to a second inverting (−) input of the differential amplifier (14), characterized in that the phase shifting component (23) is arranged outside the integrated circuit (1) and in that a plurality of separate pins (4, 5) of the integrated circuit (1) are provided for coupling the phase shifting component (23) to the output of the load current supply means (16, 20) and to the feedback path.

2. The telecommunication terminal as claimed in claim 1, characterized in that the load current supply means (16, 20) comprises a transistor (20) and in that a cascode combination (16) is used for coupling the output of the differential amplifier (14) to the control input of the transistor (20) supplying the load current.

3. The telecommunication terminal as claimed in claim 2, characterized in that two separate ground leads (GND1, GND2) which are coupled to an external ground lead (GND) via two pins (3, 7) of the integrated circuit (1) are used in the integrated circuit (1) for the differential amplifier (14) and the cascode combination (16).

4. The telecommunication terminal as claimed in one of the claim 1, characterized in that a voltage divider (24, 25) is used for coupling the load (22) to the feedback path.

5. The telecommunication terminal as claimed in one of the claims 1, characterized in that a constant voltage source (9, 10) coupled to an external voltage source (6) via a pin (2) of the integrated circuit (1) is used for producing the reference voltage (UREF).

6. The telecommunication terminal as claimed in claim 5, characterized in that a low-pass filter (11) is inserted between the constant voltage source (9, 10) and the differential amplifier (14).

7. The telecommunication terminal as claimed in 1, characterized in that the voltage controller (8) is arranged in the integrated circuit (1) and in that both the load (22) and the phase shifting component (23) are arranged outside the integrated circuit (1).

8. The telecommunication terminal as claimed in one of the claims 1 to 7, characterized in that a capacitor (23) connected in parallel with the load (22) is used as the phase shifting component.

9. An integrated circuit (1) comprising a voltage controller (8) which includes:

a differential amplifier (14) having a first noninverting input (+) for receiving a reference voltage (UREF), means (16, 20) for applying a load current to a load (22) that is provided with at least one phase shifting component (23) in dependence on an output voltage of the differential amplifier (14), and a feedback path for feeding back a voltage at the load (22) to a second inverting (−) input of the differential amplifier (14), characterized in that the phase shifting component (23) is arranged outside the integrated circuit (1) and in that a plurality of separate pins (4, 5) of the integrated circuit (1) are provided for coupling the phase shifting component (23) to the output of the load current supply means (16, 20) and to the feedback path.

10. The integrated circuit as claimed in claim 9, characterized in that the load current supply means (16, 20) comprises a transistor (20) and in that a cascode combination (16) is used for coupling the output of the differential amplifier (14) to the control input of the transistor (20) supplying the load current.

11. The integrated circuit as claimed in claim 10 characterized in that two separate ground leads (GND1, GND2) which are coupled to an external ground lead (GND) via two pins (3, 7) of the integrated circuit (1) are used in the integrated circuit (1) for the differential amplifier (14) and the cascode combination (16).

12. The integrated circuit as claimed in claim 9 characterized in that a voltage divider (24, 25) is used for coupling the load (22) to the feedback path.

13. The integrated circuit as claimed in claim 9 characterized in that a constant voltage source (9, 10) coupled to an external voltage source (6) via a pin (2) of the integrated circuit (1) is used for producing the reference voltage (UREF).

14. The integrated circuit as claimed in claim 13 characterized in that a low-pass filter (11) is inserted between the constant voltage source (9, 10) and the differential amplifier (14).

15. The integrated circuit as claimed in claim 9 characterized in that the voltage controller (8) is arranged in the integrated circuit (1) and in that both the load (22) and the phase shifting component (23) are arranged outside the integrated circuit (1).

16. The integrated circuit as claimed in claim 9, characterized in that a capacitor (23) connected in parallel with the load (22) is used as the phase shifting component.

* * * * *